United States Patent [19]

Kramer

[11] Patent Number: 4,628,563

[45] Date of Patent: Dec. 16, 1986

[54] PAINT CAN RIM AND LID SCRAPER

[76] Inventor: John H. Kramer, 30309 Driftwood Dr., Gold Beach, Oreg. 97444

[21] Appl. No.: 733,897

[22] Filed: May 14, 1985

[51] Int. Cl.[4] ..... B44D 3/16

[52] U.S. Cl. ..... 15/105; 15/236 R

[58] Field of Search ..... 15/236 R, 105

[56] References Cited

U.S. PATENT DOCUMENTS

| | | | |
|---|---|---|---|
| 1,421,478 | 7/1922 | Hope . | |
| 2,524,475 | 10/1950 | Renz . | |
| 2,646,581 | 7/1953 | Nelson | 15/105 X |
| 2,652,582 | 9/1953 | McCroba | 15/236 R |
| 2,777,676 | 1/1957 | Carter | 15/236 R |
| 3,551,937 | 1/1971 | Nelson | 15/236 R |
| 3,604,047 | 9/1971 | Hennigan | 15/236 R |
| 4,112,537 | 9/1978 | Heuck | 15/236 C X |

*Primary Examiner*—Chris K. Moore

*Attorney, Agent, or Firm*—Klarquist, Sparkman, Campbell, Leigh & Whinston

[57] ABSTRACT

A tool for scraping paint from the interengaging groove and lip portions of paint can rims and lids is disclosed. In a preferred embodiment, the tool is a flat member having three protruding arms. The end of each arm is specifically adapted to engage one of the surfaces to be cleaned: the lip of the lid, the top of the can rim or the underside of the can rim. The unused arms may be employed as handles to facilitate use of the tool.

7 Claims, 6 Drawing Figures

PAINT CAN RIM AND LID SCRAPER

BACKGROUND OF THE INVENTION

This invention relates generally to scraper tools, and more particularly to scraper tools used to remove and recover paint from the interengaging annular grooves and lips of paint can rims and lids.

Liquids such as paint are commonly packaged in resealable metal cans. Such cans typically have a groove around their top rim which is designed to receive the downward-protuding lip or bead of a mating lid. When the lid is forced down on the rim of the can, the interengaging lip and groove mate to form an airtight seal.

It should be here understood that while reference is made, as a matter of convenience, to paint cans, the tool of the present invention is equally useful with cans containing a great variety of liquid and viscous products, such as tars, resins, adhesives, sealers and epoxies.

When a paint can is opened, the interengaging lip and groove portions of the lid and can rim often become coated with paint. If these paint-coated lip and groove portions are not cleaned after each use, they may no longer interengage to form an airtight seal. If an airtight seal is not provided, the paint will soon harden and become useless. An improperly sealed can may also leak, wasting paint and necessitating costly cleanup. Some canned products also have toxic fumes that, if not properly contained, may be hazardous.

The reopening of paint cans is also facilitated by having clean interengaging grooves and lips. If the grooves and lips are coated with paint when the can is sealed, the paint left between the groove and lip will eventually dry and act to glue the lid to the can.

To promote proper sealing of paint cans, painters sometimes use a rag to clean paint from the mating lip and groove portions of the paint can rim and lid. This method is ineffective for removal of hardened paint. Furthermore, this method can be messy, and the paint so removed is discarded with the rag.

Other painters use a paintbrush to remove paint from paint can rims and lids. This method is again ineffective for removal of hardened paint. This method also often results in wet paint overflowing the rim and dripping down the sides of the can. The recovered paint may, however, be applied to the surface being painted.

Both the rag and paintbrush methods are generally unsuitable for recovering paint that clings to the underside of a paint can rim. To use a paintbrush for this purpose would necessitate holding the paintbrush, inverted, inside the can. The painter would likely get the knuckles of his hand and the handle of the brush covered with paint. The rag method suffers from a similar drawback and does not permit the recovered paint to be applied to the painted surface.

Accordingly, a need remains for a better tool to remove paint from the rim and lid of a paint can.

PRIOR ART

The scraper tools known to the inventor do not include the features of the present invention. The scraper attachment for paintbrushes disclosed in U.S. Pat. No. 1,421,478 to Hope, for example, shows a blade-type paint scraper suitable only for scraping blistered paint from a planar surface.

Other tools known to the inventor have been devised to facilitate the opening of paint cans. U.S. Pat. No. 2,524,475 to Renz shows a paint-mixing paddle which includes a protruding tooth adapted to engage and remove the lid of a paint can. The lid engagement feature, however, is not used for paint removal purposes.

SUMMARY OF THE INVENTION

It is an object of the present invention to provide a tool that can scrape clean the lips and grooves of a paint can rim and lid, thereby facilitating the resealing and reopening of the can.

It is yet another object of the present invention to provide a tool that can remove, for purposes of economics and cleanliness, any contents of the can which may cling to the inside top of the can under the rim.

Yet another object of the present invention is to provide such a scraping tool which is lightweight and inexpensive.

The present invention is a tool for scraping paint from the interengaging groove and lip portions of paint can rims and lids. In a preferred embodiment, the tool is a flat member having three protruding arms. The end of each arm is specifically adapted to engage one of the surfaces to be cleaned: the lip of the lid, the top of the can rim or the underside of the can rim. The unused arms may be employed as handles to facilitate use of the tool. The thin, flat nature of the tool allows it to be affixed temporarily, as by tape, to the outside of the lid of a can so that a can of paint and the tool can be marketed as a package, if desired.

The foregoing and additional objects, features and advantages of the present invention will be more readily apparent from the following detailed description of a preferred embodiment thereof which proceeds with reference to the accompanying drawings.

DETAILED DESCRIPTION OF PREFERRED EMBODIMENT

Figure 1:
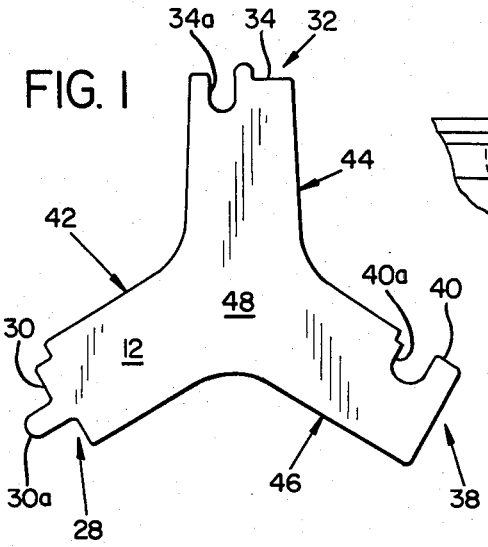
FIG. 1 is a plan view of a scraping tool in accordance with the present invention.
Figure 2:
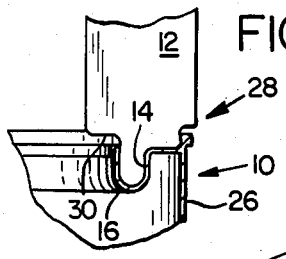
FIG. 2 is a view of a portion of the scraper shown in FIG. 1 engaging the rim groove of a paint can.
Figure 3:
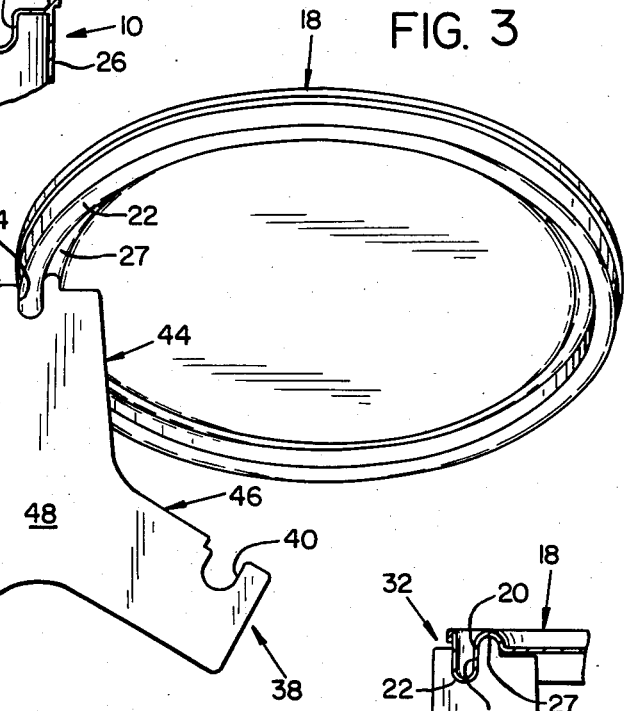
FIG. 3 is a perspective view of the scraper tool of FIG. 1 being used to clean the groove and bead portion of the underside of a paint can lid.
Figure 3A:
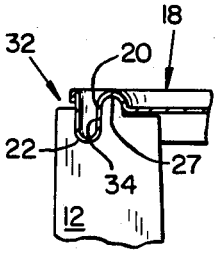
FIG. 3*a* is a detail showing a portion of the scraper of FIG. 1 engaging the groove and bead portion of the underside of a paint can lid.

With reference to FIGS. 2 through 4*a*, the can 10 with which the scraper tool 12 of the present invention is used has an upwardly-opening annular rim groove 14 forming a downwardly-protruding annular rim bead 16. Likewise, the lid 18 of can 10 includes an upwardly-opening annular lid groove 20 forming a downwardly-protruding annular lid bead 22. A downwardly-opening annular rim pocket 24 is disposed between rim bead 16 and the can sidewall 26. A downwardly-opening annular lid groove 27 is disposed inwardly adjoining lid bead 22.

Tool 12 of the present invention, shown in FIG. 1, is a thin, flat, one piece member having marginal edge portions. These edge portions include a first marginal edge portion 28 includes a first irregular scraping edge 30 shaped complementally to rim groove 14. It is therefore characterized by the projection 30*a*. First scraping edge 30 is sized for insertion of projection 30*a* in rim groove 14 and for scraping paint residue therefrom.

A second marginal edge portion 32 is spaced from first marginal edge portion 28 and includes a second scraping edge 34 shaped complementally to lid bead 22 and inwardly-adjoining lid groove 27. Edge 34 is characterized by the notch 34*a* for receiving such bead. Second scraping edge 34 is sized to fit snugly over lid bead 22 and inwardly-adjoining lid groove 27 to scrape out paint residue.

Tool 12 further includes a third marginal edge portion 38, spaced from first and second marginal edge portions 28 and 32. Third marginal edge portion 38 includes a third scraping edge 40 shaped complementally to downwardly-protruding rim bead 16 and adjoining downwardly-opening rim pocket 24. Scraping edge 40 is therefore characterized by the notch 40*a*. Third scraping edge 40 is sized for insertion over rim bead 16 and into rim pocket 24 for scraping out paint residue.

Figure 4A:
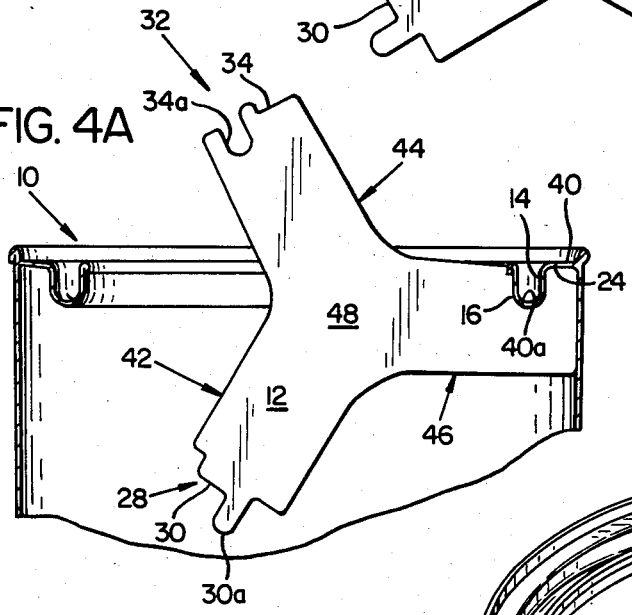
FIG. 4*a* is a sectional view of a portion of a paint can and showing the scraper of FIG. 1 engaging the underside of the can rim.
Figure 4:
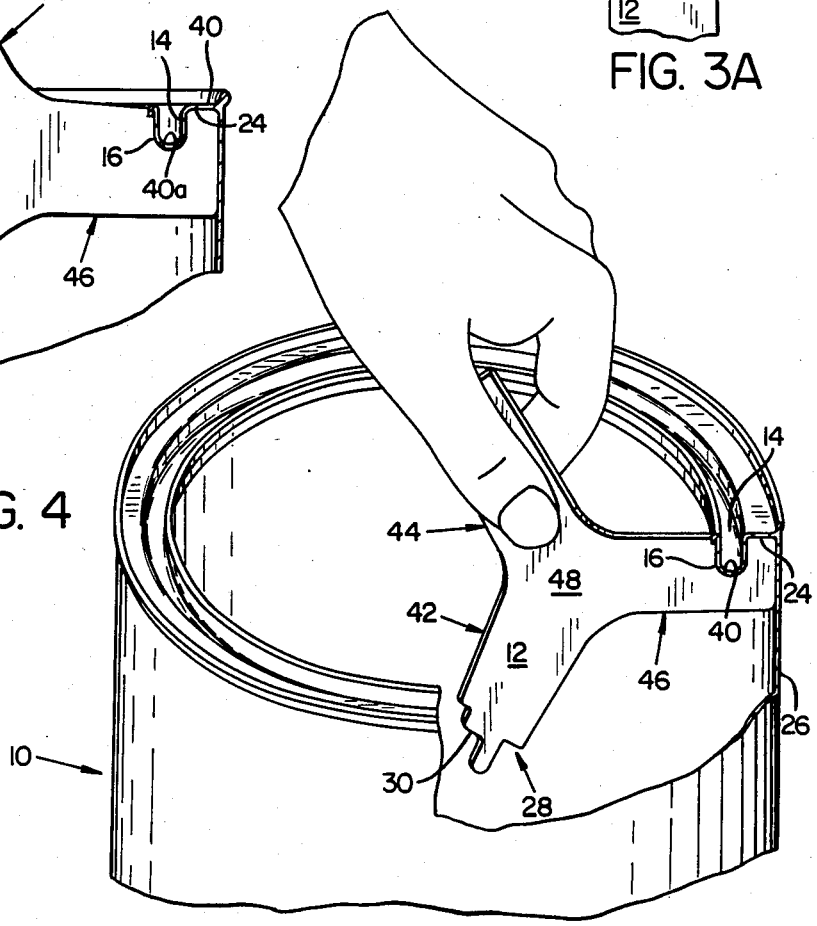
FIG. 4 is a perspective view of the scraper of FIG. 1 being used to clean the underside of a paint can rim with a portion of the can being broken away for clarity.

Each of marginal edge portions 28, 32 and 38 described above are, in the illustrated embodiment, provided on a different one of three separate arms or triparts 42, 44 and 46. Arms 42, 44 and 46 extend radially from and are arranged symmetrically about a common central hub 48. In such embodiment, one of the triparts conveniently provides a handle means while another of the triparts functions as a scraper, as shown in FIG. 4.

In the preferred embodiment, first and second marginal edge portions 28 and 32 are at the end edges of two arms 42 and 44, and third marginal edge portion 38 extends along a side edge of arm 46 near its outer end.

Having illustrated and described the principles of my invention with reference to a preferred embodiment, it should be apparent to those persons skilled in the art that such embodiment may be modified in arrangement and detail without departing from such principles. I claim as my invention all such modifications as come within the true spirit and scope of the following claims.

I claim:

1. A scraping tool for scraping paint and other viscous materials from the annular sealing grooves and lips on the rims and lids of paint cans and the like, said cans having upwardly-opening rim and lid grooves forming downwardly-protruding rim and lid beads, a downwardly-opening rim pocket between the rim bead and can sidewall, and a downwardly-opening lid groove inwardly adjoining the lid bead, said tool comprising:

a thin, flat, one-piece plate-like member having marginal edge portions;

a first said marginal edge portion including a first scraping edge shaped complementally to said rim groove and sized for insertion therein for scraping residue therefrom;

a second said marginal edge portion spaced from said first portion and including a second scraping edge shaped complementally to said lid bead and inwardly-adjoining lid groove and sized to fit thereon for scraping residue therefrom; and said member providing integral handle means for gripping said member while applying said portions.

2. An apparatus according to claim 1 including a third marginal edge portion spaced from said first and second portions, the third marginal edge portion including a third scraping edge shaped complementally to the rim bead and adjoining rim pocket and sized for insertion over the rim bead and into the rim pocket for scraping residue therefrom.

3. The apparatus of claim 2 in which the three said marginal edge portions are provided on three separate arms of said member extending from a common central hub portion.

4. An apparatus according to claim 3 in which the arms extend radially from and are arranged symmetrically with respect to the hub.

5. An apparatus according to claim 4 in which the first and second marginal edge portions are at the end edges of two of the arms and the third marginal edge portion is along a side edge portion near the outer end of an arm.

6. An apparatus according to claim 1 wherein said member has a tripartite shape with each said marginal edge portions provided on a different one of said triparts.

7. An apparatus according to claim 6 in which one of said triparts provides a handle means while another of said triparts functions as a scraper means.

* * * * *